US005226571A

United States Patent [19]

Eastwood et al.

[11] Patent Number: 5,226,571

[45] Date of Patent: Jul. 13, 1993

[54] BOX DISPENSER MADE FROM CORRUGATED BOARD

[75] Inventors: Richard F. Eastwood; Alan Culbert; Carlo P. Dorazio; Nick Corriero, all of Mississauga, Canada

[73] Assignee: Central Box and Container Limited, Mississauga, Canada

[21] Appl. No.: 876,976

[22] Filed: May 1, 1992

[51] Int. Cl.[5] ..... B26F 3/02

[52] U.S. Cl. ..... 225/49; 225/91

[58] Field of Search ..... 225/39, 48, 49, 91

[56] References Cited

U.S. PATENT DOCUMENTS

| | | | |
|---|---|---|---|
| 1,887,912 | 11/1932 | Begle | 225/49 |
| 2,096,107 | 10/1937 | Haggerty | 225/49 X |
| 2,189,533 | 2/1940 | Harvey | 225/49 |
| 2,336,842 | 12/1943 | Broeren et al. | 2225/49 X |
| 3,169,685 | 2/1965 | Reilly | 225/49 X |
| 3,547,328 | 12/1970 | Bjorklund | 225/49 |
| 3,933,288 | 1/1976 | Struble | 225/49 |
| 4,346,830 | 8/1982 | Hauser | 225/49 |
| 4,399,935 | 8/1983 | Nelder | 225/49 |
| 4,715,519 | 12/1987 | Fischer | 225/48 |
| 4,967,911 | 11/1990 | Lo Duca | 206/626 |

FOREIGN PATENT DOCUMENTS

| | | |
|---|---|---|
| 1041817 | 11/1978 | Canada . |
| 0127241 | 5/1990 | Japan . |
| 1282045 | 7/1972 | United Kingdom . |

*Primary Examiner*—Frank T. Yost
*Assistant Examiner*—Raymond D. Woods
*Attorney, Agent, or Firm*—Samuels, Gauthier & Stevens

[57] ABSTRACT

A box dispenser for dispensing rolled-materials is fabricated of single wall corrugated board having a corrugated medium comprising E-flute glued between two facings. The dispenser is provided with a cutting edge. The cutting edge is formed by die-cutting an appropriate edge of the box adjacent to the dispensing opening to form serrations. The cutting edge is reinforced and strengthened by filling the interstitial voids between the two facings and the fluting at the cutting edge with a fast setting glue which adheres to the fluting and facings to provide a rigid, reinforced cutting edge which can resist being crushed or dulled by constant dispensing of the rolled material.

8 Claims, 3 Drawing Sheets

BOX DISPENSER MADE FROM CORRUGATED BOARD

FIELD OF THE INVENTION

The present invention relates to containers made from corrugated board for dispensing rolled materials.

BACKGROUND OF THE INVENTION

The production of environmentally safe and readily disposable packaging has become a priority as ways of reducing non-degradable waste are being vigorously pursued. One class of packaging containers which comprise materials not readily susceptible to quick degradation are industrial strength box dispensers for dispensing rolled materials such as aluminum foil, wax paper and the like. These box dispensers are made of corrugated board and include a serrated cutting edge which must withstand considerable usage. The cutting edge is usually formed of a serrated metal or plastic strip which is attached to the dispenser. When the container is emptied it is usually discarded, and therefore presents a source of non-degradable waste in addition to being a potential hazard with the cutting edge still intact. Recycling of the cutting edges may not be economical.

Accordingly, it would be advantageous to provide a rolled material dispensing corrugated board box fabricated of a material which avoids a non-degradable cutting edge.

SUMMARY OF THE INVENTION

The subject invention provides a container for dispensing rolled material which includes a container portion fabricated from a corrugated board material comprising fluted medium sandwiched between face members. The corrugated material has interstitial voids between the face members and the medium and the container portion has an opening for dispensing the rolled material therefrom.

There is provided a cutting edge formed in an edge of the corrugated board material adjacent the container opening. A solid filler material is provided which substantially fills said interstitial voids along the cutting edge and adhered to the fluted medium and the face members for reinforcing and strengthening the cutting edge.

In another aspect of the invention, there is provided a box dispenser for dispensing rolled material. The box dispenser comprises a generally rectangular container having a dispensing opening, a base panel having opposed end edges, a rear wall panel, a top wall panel attached to said rear wall panel, a pair of spaced side wall panels attached to the opposed end edges of the base panel and a front wall panel attached to said base panel. The container is fabricated from a corrugated board material comprising fluted medium sandwiched between face members and the corrugated material has interstitial voids between the face members and the medium. Included is a cutting edge formed in an edge of the corrugated board material of the container adjacent the dispensing opening. Provided is a solid filler material substantially filing the interstitial voids along the cutting edge and adhered to the fluted medium and the face members for reinforcing and strengthening the cutting edge.

BRIEF DESCRIPTION OF THE DRAWINGS

The following is a description, by way of example only, of embodiments of a box dispenser made in accordance with the present invention, in which.

DETAILED DESCRIPTION OF THE INVENTION

Figure 1:
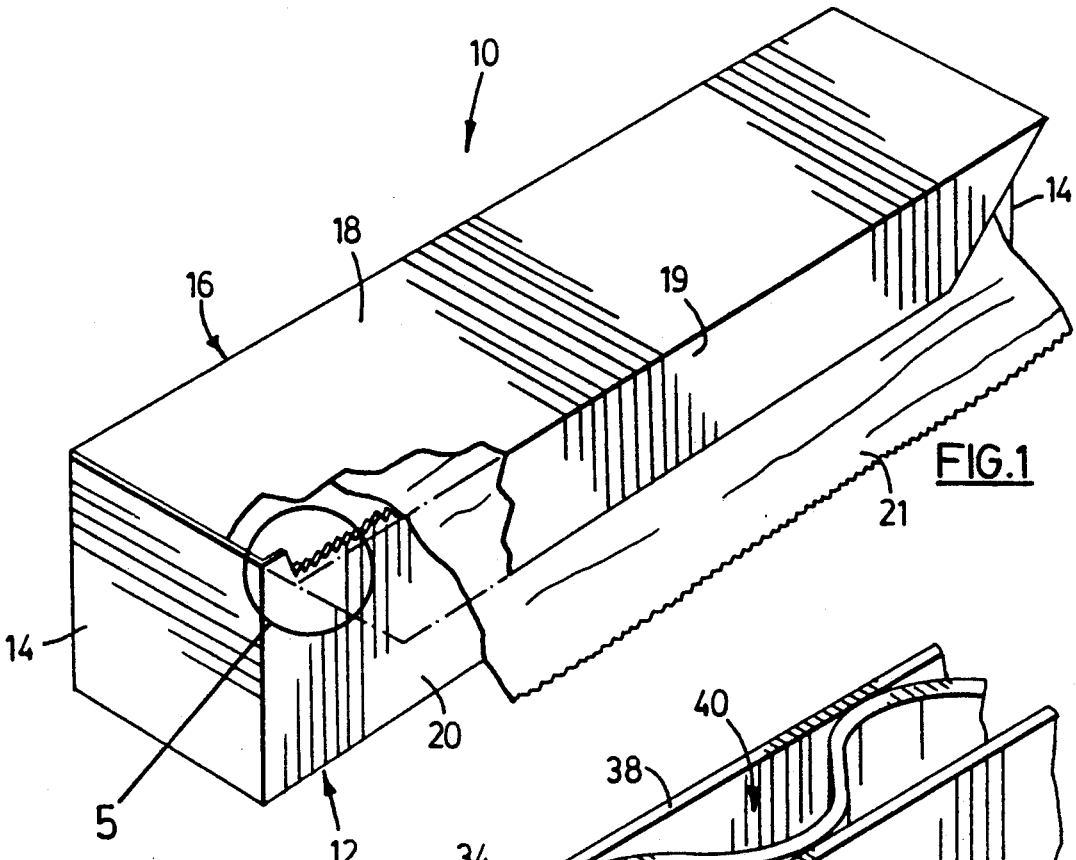
FIG. 1 is a perspective view of a box dispenser constructed in accordance with the present invention.
Figure 3:
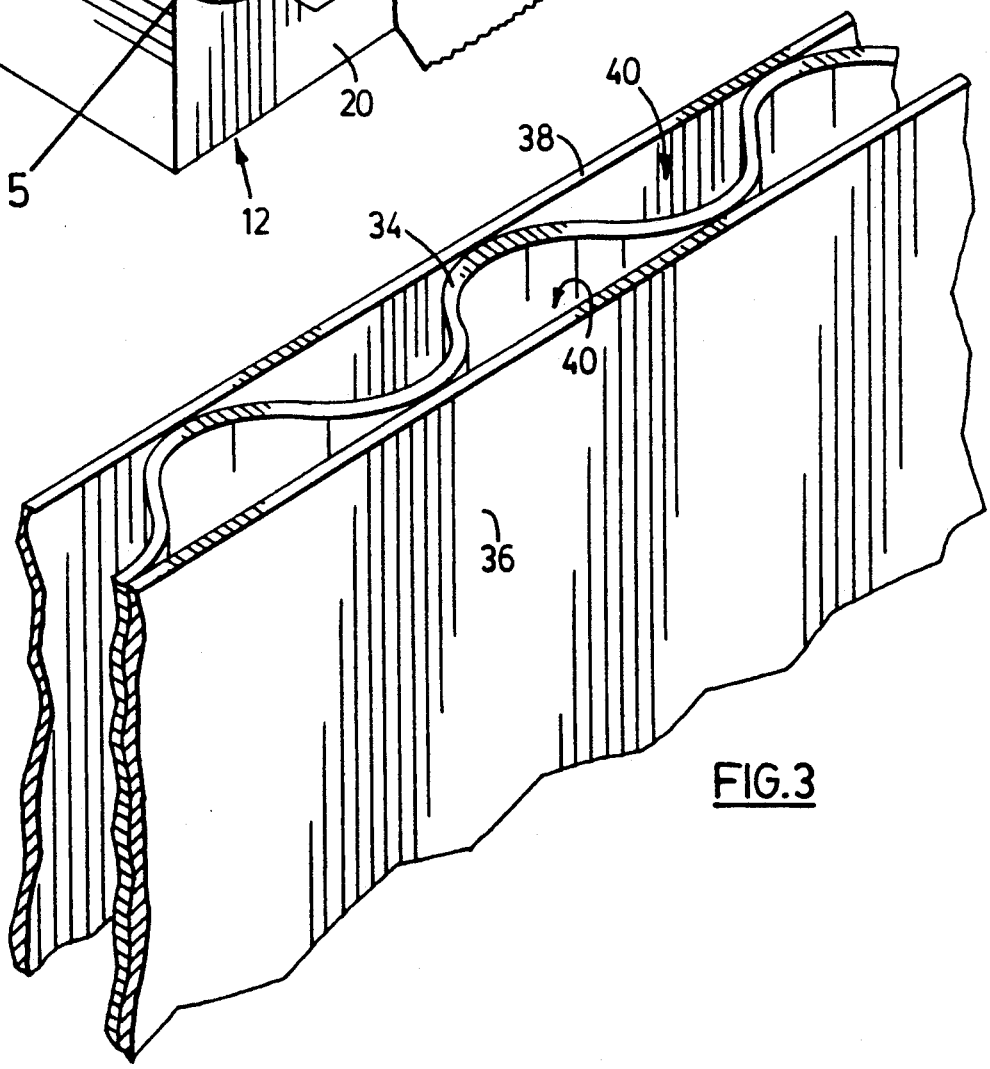
FIG. 3 is a perspective view of one type of corrugated board used to fabricate the box dispenser of the present invention.
Figure 2:
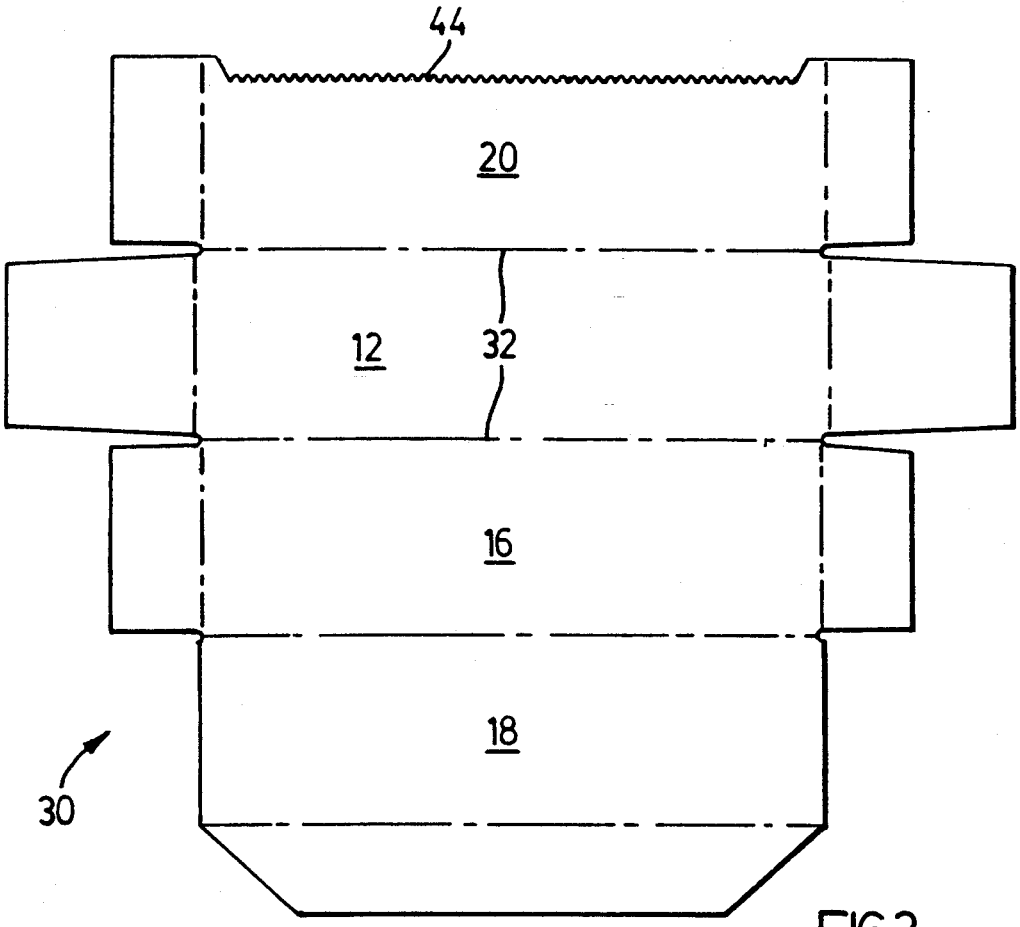
FIG. 2 is a plan view of a carton blank used to make the box dispenser shown in FIG. 1.

Referring to FIG. 1, a container or box dispenser 10 includes a base panel 12, a pair of spaced side panels 14 attached to the opposed ends of base panel 12, a rear panel 16, a top panel 18 with flap 19 and a front panel 20. Dispenser 10 is shown with a roll of material 21 located therein. The dispenser box blank 30 is formed from a single die-cut blank illustrated in FIG. 2 at 30 wherein various panels are bounded by the scored lines 32. Box dispenser 10 is fabricated from single wall corrugated board, also known in the art as "Double Face" which, with reference to FIG. 3, includes a fluted corrugating medium 34 glued between two flat facings 36 and 38. Located between medium 34 and the facings 36 and 38 are interstitial voids 40. The fluted corrugating medium comprises E-flute which has between 85 to 100 flutes per linear foot.

Figure 4:
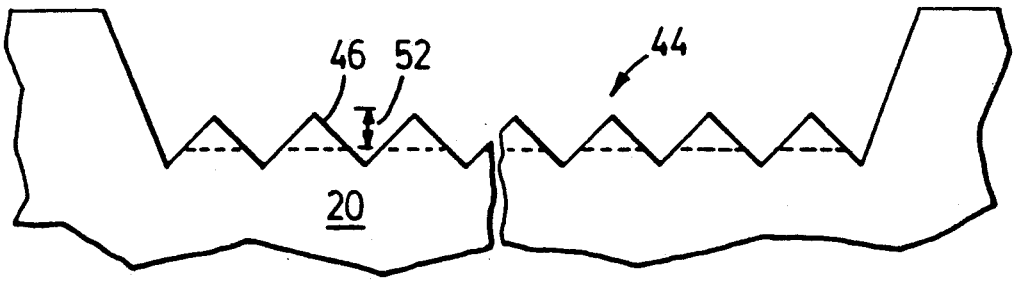
FIG. 4 is a broken away elevation of a portion of the box dispenser of FIG. 1.

Dispenser 10 is provided with a cutting edge 44 along the upper edge of front panel 20. Cutting edge 44 is formed by die-cutting the edge of panel 20 to form generally triangular cutting teeth 46, best seen in FIG. 4.

Figure 5:
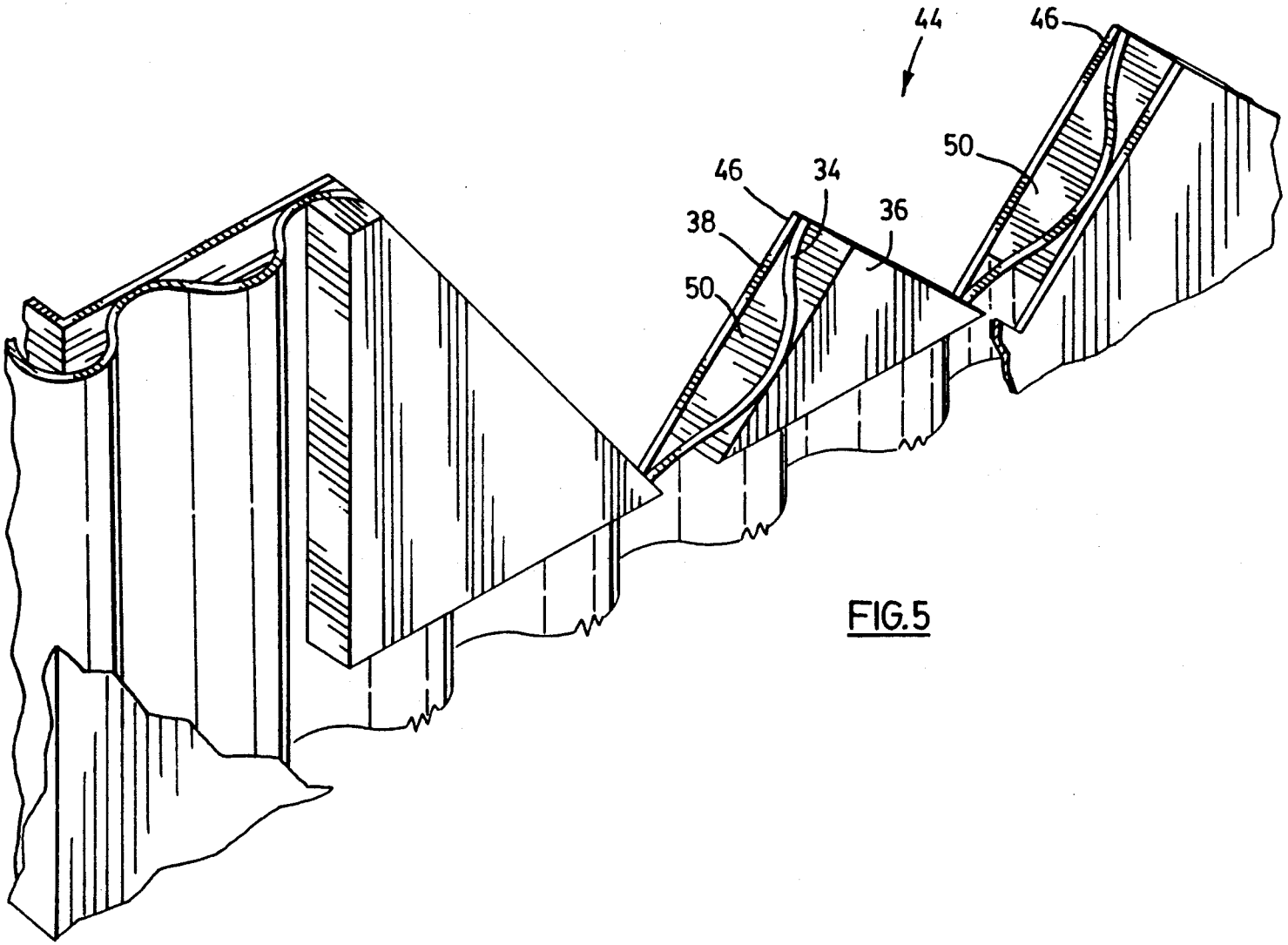
FIG. 5 is an enlargement of the area designated as 5 in FIG. 1.

With reference to FIG. 5, cutting edge 44 is reinforced by filling the interstitial voids 40 located along the edges of cutting teeth 46 with a liquid filler material. The filler material is one which hardens upon setting to form a hardened solid mass 50 and has suitable viscosity and adhesive properties in order to fill and adhere to facings 36, 38 and medium 34 when it sets. The filler material is a coating, glue or epoxy, which forms solid mass 50 when it hardens and which is preferably fast setting. Any glue or epoxy which is FDA approved for use in food related box dispensers may be used as the filler material. One such material which has been found to perform well is #2899 Coating produced by Technical Adhesives Limited of Mississauga, Ontario, Canada, and which conforms to FDA regulation 182.90 (Substances migrating to food from paper and paperboard products). This material hardens in a matter of seconds after being applied.

Box dispenser 10 is suitable for dispensing rolled materials 21 (FIG. 1) such as plastic film, aluminum foil and wax paper to mention just a few. The rolled material to be dispensed is pulled out of dispenser 10 to the desired length and pulled downwardly and away from dispenser 10 whereupon the sheet is cut along the portion thereof lying adjacent cutting teeth 46.

The presence of solid filler material 50 in the interstitial voids 40 acts to prevent the two facings 36 and 38 along the peripheral edge of the cutting teeth 46 from being compressed together or flattened down and thus avoids degradation of the cutting edge during prolonged usage as is observed to occur with un-reinforced cutting edges. Accordingly, the box dispenser fabricated with the reinforced cutting edges as disclosed herein is suitable for use in industrial applications as it provides a cutting edge which retains its sharpness with prolonged use.

While the embodiment of the box dispenser discussed above is provided with the cutting edge 44 disposed along the upper edge of front panel 20, it will be understood that the cutting edge could be located in any functionally equivalent position on the dispenser. For example, a cutting edge could be located along the free edge of the flap 19.

Those skilled in the art will appreciate that there are numerous methods of applying the filler material to cutting edge 44. One method involves applying the liquid filler material onto the edge 44 of the blank 30 with a suitable brush or roller so that liquid flows into and along interstitial spaces 40 so as to form a narrow band of filler material shown at 52 in FIG. 4 which hardens as mass 50. The thickness of band 52 depends in part on the viscosity of the liquid filler material, and the exposure time of cutting edge 44 to the liquid when the latter is applied to the former. This method of applying the filler material can be utilized to coat a large number of cutting edges by stacking the box blanks with the cutting edges 44 aligned and exposed. The liquid filler material is then applied to cutting edges 44 by either brushing or painting as discussed above and may be accomplished either manually or employing known automated methods.

In another method of applying the liquid filler material, cutting edges 44 of the blanks may be dipped a predetermined distance into a tray containing the liquid filler and withdrawn after a predetermined period of time.

In still another method of applying the liquid filler material, the liquid may be sprayed onto cutting edges 34 using known batch spraying techniques.

The resulting box dispenser is more environmentally benign than prior dispensers using a separate metal or plastic cutting edge affixed to the box and having separate labels affixed thereto.

The cutting edge described herein has been formed by die-cutting an edge of one of the panels to provide cutting teeth.

While the box dispenser made from corrugated board has been described and illustrated with respect to the preferred embodiment, it will be appreciated that numerous variations of these embodiments may be made without departing from the scope of the invention described herein.

What is claimed is:

1. A container for holding and dispensing rolled material, comprising:

a) a container portion fabricated from a corrugated board material comprising fluted medium sandwiched between face members, the corrugated material having interstitial voids between the face members and the medium, the container portion having an opening for dispensing said rolled material therefrom;

b) a cutting edge formed in an edge of said corrugated board material adjacent said container portion opening; and c) a solid filler material substantially filling said interstitial voids along said cutting edge and adhered to said fluted medium and said face members for reinforcing and strengthening said cutting edge.

2. A container according to claim 1 wherein the corrugated board material is a single walled corrugated board and the fluted medium sandwiched between said face members is E-flute which has between 85 to 100 flutes per linear foot.

3. A container according to claim 2 wherein said cutting edge is a serrated edge comprising a plurality of tooth members.

4. A container according to claim 3 wherein said filler material comprises a liquid filler material which adheres to the face members and the fluted medium and sets to form a solid hardened mass.

5. A container according to claim 4 wherein the cutting edge is formed along one edge of said container portion opening.

6. In a box dispenser of the type made of corrugated board, the corrugated board having a fluted medium sandwiched between facings and having interstitial voids between the facings and the fluted medium, having a dispenser opening the improvement comprising:

a) a cutting edge formed in said corrugated board; and b) hardened filler material substantially filling the interstitial voids between the fluted medium and the facings along said cutting edge whereby the cutting edge is reinforced.

7. The box dispenser according to claim 6 wherein the corrugated board is fabricated of single walled corrugated board comprising E-flute sandwiched between two facings, the cutting edge being a serrated cutting edge comprising a plurality of spaced tooth members, and wherein the filler material comprises a liquid filler material which is applied to the cutting edge in such a way so as to substantially fill the interstitial voids along the cutting edge and which adheres to said two facings and said E-flute and sets to form a hardened solid.

8. A box dispenser for dispensing rolled material, comprising;

a) a generally rectangular container having a dispensing opening, a base panel having opposed end edges, a rear wall panel attached to said base panel, a top wall panel attached to said rear wall panel, a pair of spaced side wall panels attached to the opposed end edges of said base panel and a front wall panel attached to said base panel, the container fabricated from a corrugated board material comprising fluted medium sandwiched between face members, the corrugated material having interstitial voids between the face members and the medium;

b) a cutting edge formed in an edge of said corrugated board material of said container adjacent said dispensing opening; and c) a solid filler material substantially filling said interstitial voids along said cutting edge and adhered to said fluted medium and said face members for reinforcing and strengthening said cutting edge.

* * * * *